US010390142B2

(12) United States Patent
Schwarz

(10) Patent No.: US 10,390,142 B2
(45) Date of Patent: Aug. 20, 2019

(54) LOUDSPEAKER ARRANGEMENT

(71) Applicant: ECOM Instruments GmbH, Assamstadt (DE)

(72) Inventor: Michael Schwarz, Igersheim (DE)

(73) Assignee: ECOM Instruments GmbH (DE)

( * ) Notice: Subject to any disclaimer, the term of this patent is extended or adjusted under 35 U.S.C. 154(b) by 0 days.

(21) Appl. No.: 16/195,123

(22) Filed: Nov. 19, 2018

(65) Prior Publication Data

US 2019/0158959 A1 May 23, 2019

(30) Foreign Application Priority Data

Nov. 20, 2017 (DE) ..... 10 2017 220 713

(51) Int. Cl.

| | |
|---|---|
| ***H04R 9/04*** | (2006.01) |
| ***H04R 3/00*** | (2006.01) |
| ***H04R 9/06*** | (2006.01) |
| ***H04R 7/12*** | (2006.01) |

(52) U.S. Cl.

CPC ..... *H04R 9/046* (2013.01); *H04R 3/00* (2013.01); *H04R 7/12* (2013.01); *H04R 9/06* (2013.01)

(58) Field of Classification Search

CPC . H04R 9/046; H04R 3/00; H04R 7/12; H04R 9/06

See application file for complete search history.

(56) References Cited

U.S. PATENT DOCUMENTS 3,497,638 A * 2/1970 Cohen ..... H04R 13/00 381/189

FOREIGN PATENT DOCUMENTS

CN 202602842 U 12/2012

* cited by examiner

*Primary Examiner* — Andrew L Sniezek
(74) *Attorney, Agent, or Firm* — Fishman Stewart PLLC

(57) ABSTRACT

A loudspeaker arrangement may include a loudspeaker having first and second voice coils to provide motive force for a loudspeaker membrane, and an electric transformer having a primary coil connectable electrically to an electrical power unit, and a secondary coil connectable electrically to the first and second voice coils. The voice coils each may have two first winding ends connected to each other via a first electrical conducting path to form a parallel electrical circuit and two second winding ends connected to each other via a second electrical conducting path. The first electrical conducting path may be connected electrically to a first winding end of the secondary coil via a first electrical connecting path and via an additional first electrical connecting path, which may form a parallel circuit with the first electrical connecting path. The second electrical conducting path may be connected electrically to a second winding end of the secondary coil via a second electrical connecting path and via an additional second electrical connecting path, which may form a parallel circuit with the second electrical connecting path.

20 Claims, 1 Drawing Sheet

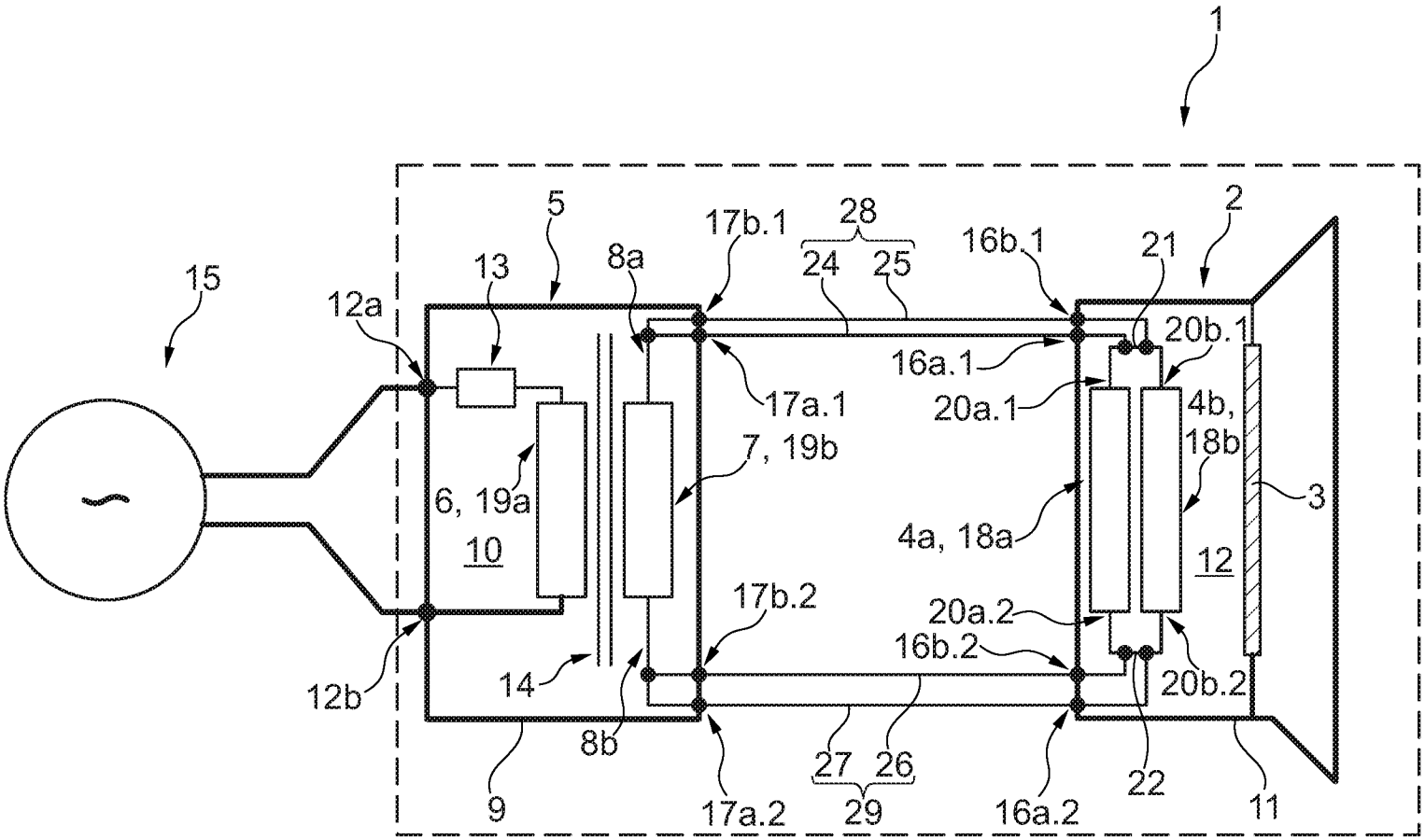
1
2
3
11
12
4b, 18b
20b.1
20b.2
21
22
16b.1
16a.2
16a.1
20a.1
4a, 18a
20a.2
16b.2
25
26
28
24
27
29
17a.1
7, 19b
17b.2
17b.1
17a.2
8a
8b
5
14
9
13
6, 19a
10
12a
12b
15

LOUDSPEAKER ARRANGEMENT

CROSS REFERENCE TO RELATED APPLICATIONS

This application claims priority to DE-102017220713.2, filed Nov. 20, 2017, the contents of which is hereby incorporated by reference in its entirety.

TECHNICAL FIELD

The present invention relates to a loudspeaker arrangement.

BACKGROUND

In potentially explosive areas, on drilling rigs, for example, the electrical energies present on external electronic interfaces of an electronic device may ignite a gas-air mixture which exists in this potentially explosive area and cause it to explode. This applies in particular when reactive gas mixtures are used, for example mixtures of hydrogen and oxygen, for which said electrical is available as activation energy to trigger an exothermic reaction between hydrogen and oxygen.

A similar set of difficulties exists for sound-generating loudspeakers and their electric voice coils for providing the motive force to the loudspeaker membrane. In the event of a malfunction, in particular an interruption in the electric current flow through the voice coil because of a broken electrical conducting path, a very high induction voltage can be generated by the voice coil, which may consequently result in an undesirable spark ignition. A similar phenomenon occurs if the loudspeaker overheats due to a malfunction, and this may also result in an undesirable glow ignition.

In order to prevent spark or glow ignition in a loudspeaker even if a malfunction occurs, so that they can be used in potentially explosive areas, conventional loudspeakers must not be operated with high electrical power. This in turn means that with loudspeakers of such kind only a small output power can be converted into sound waves, and consequently the sound levels achievable with such loudspeakers are limited.

Patent CN 202 602 842 U discloses a loudspeaker arrangement for use in such a potentially explosive area, comprising transformers connected in parallel, the primary coils of which can be connected electrically to an electrical power unit, while the secondary coils are each connected electrically to voice coils of two loudspeakers. In this arrangement, the first and second winding ends of the secondary coils are electrically connected to a first connector path and to an additional first connector path which forms a parallel circuit with the first connector path, and to a second connector path and an additional second connector path which forms a parallel circuit with the second connector path.

SUMMARY

The present invention addresses the problem of creating a loudspeaker arrangement with which the aforementioned problems are largely or even completely eliminated. In particular, the intention is to create a loudspeaker arrangement which is suitable for use in a potentially explosive area even with high levels of converted electrical power.

This problem is solved according to the invention with the objects of the independent claims. Advantageous variants constitute the object of the dependent claims.

Accordingly, the basic idea on which the invention is based is to galvanically decouple the voice coils of the loudspeaker from the electrical energy supply with the aid of an electric transformer. If the electric energy supply should generate excessively high output power and if the loudspeaker were not galvanically isolation from the electrical energy supply, the voice coils would heat up, which in extreme cases might result in a glow ignition, which is not tolerable in a potentially explosive area. The effect of the galvanic isolation of the loudspeaker from the electrical energy supply by means of the electrical transformer is that only AC voltage signals are transmitted to the loudspeaker. In this way, overheating of the loudspeakers and thus also glow ignition may be avoided.

According to the invention, besides galvanic isolation two voice coils are to be used to drive the loudspeaker membrane rather than just one such voice coil, and for this purpose they should be connected electrically in parallel. In addition, in the solution suggested here all electrical connector paths between the coils in the electrical transformer and the two voice coils are provided twice. In the event that one of the two electrical conducting paths is interrupted, this has no negative consequences since the second electrical conducting path present, which is still intact, maintains the electrical connection between the transformer and the loudspeaker. Since the two voice coils are connected electrically in parallel, in this case the total electrical resistance of the two electrical conducting paths will double. In particular, the generation of undesirable induction voltage in the event of a malfunction may be prevented, since there is always a redundant voice coil in the current circuit between the transformer and the loudspeaker. In this way, an undesirable spark ignition in the case of electrical interruption may be avoided. Consequently, the loudspeaker arrangement presented is also suitable for use in a potentially explosive area for providing the motive force for the loudspeaker membrane even with high electrical outputs, since with this arrangement glow or spark ignition in the event of a malfunction can be prevented entirely.

A loudspeaker arrangement according to the invention for use in a potentially explosive area comprises a loudspeaker which has a first and a second voice coil for providing the motive force to the loudspeaker membrane. Said loudspeaker membrane is preferably also part of the loudspeaker. The arrangement further includes an electrical transformer with a primary coil and a secondary coil. The transformer has a primary coil which may be connected electrically, to an electric power unit for supplying the transformer with electrical energy, preferably via an electric fuse. The transformer also has a secondary coil, which is or may be connected electrically to the two voice coils of the loudspeaker. The two voice coils each have a first and a second winding end, wherein in order to create a parallel electric circuit the two first winding ends are connected to each other via a first electrical conducting path. The two second winding ends are connected to each other via a second electrical conducting path. The first electrical conducting path is connected electrically to a first winding end of the secondary coil via a first electrical connector path and also via an additional first electrical connector path, which forms a parallel circuit with the first electrical connector path. The second electrical conducting path is connected electrically to a second winding end of the secondary coil via a second electrical connector path and also via an additional second electrical connector path, which forms a parallel circuit with the second electrical connector path.

According to a preferred embodiment, the secondary coil and the two voice coils are connected electrically in parallel to each other. In this way, the release of electrical energy by induction in the event of an interruption in the electrical current flow in one of the two voice coils due to a malfunction is avoided. In addition, the electrical parallel arrangement has the effect of reducing the total inductance of the loudspeaker.

The two voice coils may advantageously be connected to each other with low impedance. In order to create such a low impedance electrical connection, suitable conventional electrical conductors are quite acceptable, preferably in the form of cables made of metal, particularly copper.

The two voice coils are advantageously connected to the secondary coil with low impedance and isolated galvanically from the primary coil of the transformer.

The two voice coils are particularly preferably designed as carry over parts, which in particular have the same inductance. This feature has the effect of lowering the cost of manufacturing the loudspeaker.

In a further preferred embodiment, two first electrical loudspeaker input connections are provided on the loudspeaker, both of which are connected electrically to each of the two first winding ends of the two voice coils. In this embodiment two second electrical loudspeaker input connections are provided on the loudspeaker, both of which are connected electrically to each of the two second winding ends of the two voice coils.

According to an advantageous further development, the loudspeaker comprises a loudspeaker housing to which the loudspeaker membrane is attached in such manner that is free to vibrate. The loudspeaker housing also encloses a loudspeaker housing interior in which the two voice coils are arranged.

Preferably, two first electrical transformer output connections are provided on the transformer, each of which are connected electrically to the first winding end of the secondary coil. In this variant, two second electrical transformer output connections are also provided on the transformer, both of which are connected electrically to each of the two second winding ends of the two voice coils.

Advantageously, a first transformer input connection is provided on the transformer, and is connected electrically to a first winding end of the primary coil. In this variant, a second transformer input connection is provided on the transformer and is connected electrically to a second winding end of the primary coil.

According to another preferred embodiment, the transformer comprises a transformer housing which is separate from the loudspeaker housing and encloses a transformer housing interior and in which the primary coil and the secondary coil are arranged.

Further important features and advantages of the invention will be apparent from the subclaims, the drawing, and the associated description of the FIGURE with reference to the drawing.

Of course, the features described in the preceding text and those which will be explained below are usable not only in the combination indicated in each case, but also in other combinations or alone without departing from the scope of the present invention.

Preferred embodiments of the invention are represented in the drawing and will be explained in greater detail in the following description.

BRIEF DESCRIPTION OF THE DRAWINGS

The single FIGURE shows an example of a loudspeaker arrangement designed for use in a potentially explosive area in the form of a circuit diagram.

DETAILED DESCRIPTION

The single FIGURE shows an example of a loudspeaker arrangement 1 which is designed for use in a potentially explosive area in the form of a circuit diagram. The loudspeaker arrangement 1 comprises a loudspeaker 2 which has a loudspeaker membrane 3 and a first and a second voice coil 4*a*, 4*b* for providing the motive force to the loudspeaker membrane 3. The first voice coil 4*a* is formed by a first coil winding 18*a*. The second voice coil 4*b* is formed by a second coil winding 18*b*. The loudspeaker 2 comprises a loudspeaker housing 11, which is only represented schematically in the FIGURE and to which the loudspeaker membrane 3 is attached in such manner as to be free to vibrate. The loudspeaker housing 11 encloses a loudspeaker housing interior 12, in which the two voice coils 4*a*, 4*b* are arranged. The two voice coils 4*a*, 4*b* serve to excite acoustic vibrations in the loudspeaker membrane 3 and are connected to it in known manner for this purpose.

The two voice coils 4*a*, 4*b* each have a first winding end 20*a*.1, 20*b*.1, which are connected electrically to each other via a first electrical conducting path 21 to create a parallel electrical circuit of the two voice coils 4*a*, 4*b*. Each of the two voice coils 4*a*, 4*b* also has a second winding end 20*a*.2, 20*b*.2, which are connected electrically to each other via a second electrical conducting path 22 to create a parallel electrical circuit of the two voice coils 4*a*, 4*b*. The loudspeaker membrane 3 is powered by means of both voice coils 4*a*, 4*b* due to the electrical parallel circuit arrangement of the two voice coils 4*a*, 4*b* explained previously.

The loudspeaker arrangement 1 also includes a transformer 5 having a primary coil 6 and a secondary coil 7. The primary coil 6 is also formed by a primary coil winding 19*a*. The secondary coil 7 is formed by a secondary coil winding 19*b*. The primary coil 6 has two electrical connections 12*a*, 12*b* for connecting the primary coil 6 to an external electric power unit 15, which is not part of the loudspeaker arrangement 1. The electric power unit 15 may be for example an output stage of a power amplifier—not shown in more detail in the FIGURE—which supplies the loudspeaker 2 with electrical energy. The secondary coil 7 of the loudspeaker arrangement 1 has two winding ends 8*a*, 8*b* auf, which are connected electrically to the two voice coils 4*a*, 4*b* of the loudspeaker 2. The electrical connection of the secondary coil 7 to the two voice coils 4*a*, 4*b* is assured via electrical connector paths 24, 25, 26, 27.

In this context, a first electrical connector path 24 connects the first electrical conducting path 21 electrically to the first winding end 8*a* of the secondary coil 7. Also, an additional first electrical connector path 25 is provided which also connects the first electrical conducting path 21 to the first winding end 8*a* in addition to the first electrical connector path 24. The first electrical connector path 24 and the additional first electrical connector path 25 are connected to each other in parallel, i.e., these two connector paths 24, 25 form a first parallel electrical circuit 28. Similarly, a second electrical connector path 26 connects the second electrical conducting path 22 electrically to the second winding end 8*b* of the secondary coil 7. Also, an additional second electrical connector path 27 is provided which connects the second electrical conducting path 22 to the second winding end 8*b* in addition to the second electrical connector path 24. The second electrical connector path 26 and the additional second electrical connector path 27 are connected in parallel to each other, i.e, these two connector paths 26, 27 form a second parallel electrical circuit 29.

The secondary coil 7 is thus electrically wired to the two voice coils 4*a*, 4*b* via the two parallel electrical circuits 28, 29 in such manner that the first winding end 8*a* is connected to the first winding ends 20*a*.1 and 20*b*.1 of both the first and the second voice coils 4*a*, 4*b* via both first electrical connector paths 24, 25 and via the first electrical conducting path 21. In the same way, the second winding end 8*b* is connected to each of the second winding ends 20*a*.2 and 20*b*.2 of both the first and the second voice coils 4*a*, 4*b* via both second electrical connector paths 26, 27 and via the first electrical conducting path 22.

Two first electric loudspeaker input connections 16*a*.1, 16*b*.1 may be present on the loudspeaker housing 11 of the loudspeaker 2, each being connected electrically to both first winding ends 20*a*.1 and 20*b*.1 of the two voice coils 4*a*, 4*b*. In addition, two second electric loudspeaker input connections 16*a*.2, 16*b*.2 may also be present on the loudspeaker housing 11 of the loudspeaker 2, each being connected electrically to both second winding ends 20*a*.2, 20*b*.2 of the two voice coils 4*a*, 4*b*. The first and second loudspeaker input connections 16*a*.1, 16*b*.1, 16*a*.2, 16*b*.2 serve to provide a dual electrical connection for the secondary coil 7 of the transformer 5 with both the first and with the second voice coils 4*a*, 4*b*.

Transformer 5 comprises a transformer housing 9, which is indicated only schematically in the FIGURE, which encloses a transformer housing interior 10, and in which the primary coil 6 and the secondary coil 7 are arranged. The transformer 5 may be embodied as a low frequency (cam follower) isolating transformer, in which primary coil 6 and primary coil 7 are wound around a soft iron core 14, which is only suggested in highly simplified schematic terms in the FIGURE. Two first electrical transformer output connections 17*a*.1, 17*b*.1 are provided on the transformer housing 9 of transformer 5, both being connected electrically to the first winding end 8*a* of the secondary coil 7. Two second electrical transformer output connections 17*a*.2, 17*b*.2 are also provided on the transformer housing 9 of transformer 5, both being connected electrically to the second winding end 8*b* of the secondary coil 7.

As may also be discerned from the FIGURE, an electric fuse 13 may be connected electrically in series with primary coil 6, and may interrupt the flow of electrical current through fuse 13 and therewith also through secondary coil 7 when a predetermined threshold value is exceeded. In this way, the loudspeaker 2 may be completely disconnected from the electrical power unit 15 in the event of a malfunction.

The invention claimed is:

1. A loudspeaker arrangement comprising:

a loudspeaker having a loudspeaker membrane, a first voice coil, and a second voice coil to provide motive force for the loudspeaker membrane;

an electric transformer having a primary coil connectable electrically to an electrical power unit, and a secondary coil connectable electrically to the first and second voice coils;

wherein the first and second voice coils each has two first winding ends and two second winding ends, the two first winding ends being connected to each other via a first electrical conducting path to form a parallel electrical circuit, and the two second winding ends being connected to each other via a second electrical conducting path;

wherein the first electrical conducting path is connected electrically to a first winding end of the secondary coil via a first electrical connecting path and via an additional first electrical connecting path, which forms a parallel circuit with the first electrical connecting path; and wherein the second electrical conducting path is connected electrically to a second winding end of the secondary coil via a second electrical connecting path and via an additional second electrical connecting path, which forms a parallel circuit with the second electrical connecting path.

2. The loudspeaker arrangement according to claim 1, wherein the secondary coil and the first and second voice coils are connected to each other electrically to form a parallel circuit.

3. The loudspeaker arrangement according to claim 2, wherein the first and second voice coils are connected to each other electrically by low impedance.

4. The loudspeaker arrangement according to claim 2, wherein the first and second voice coils are connected to the secondary coil by low impedance and are isolated galvanically from the primary coil of the transformer.

5. The loudspeaker arrangement according to claim 2, wherein the first and second voice coils are embodied as carry over parts, which have the same inductance.

6. The loudspeaker arrangement according to claim 2, further comprising:

two first electrical loudspeaker input connections on the loudspeaker, each of which is connected electrically with each of the two first winding ends of the first and second voice coils; and two second electrical loudspeaker input connections on the loudspeaker, each of which is connected electrically with each of the two second winding ends of the first and second voice coils.

7. The loudspeaker arrangement according to claim 2, wherein the loudspeaker includes a loudspeaker housing, to which the loudspeaker membrane is attached in such manner as to be able to vibrate freely, and which encloses a loudspeaker housing interior, in which the first and second voice coils are arranged.

8. The loudspeaker arrangement according to claim 2, further comprising:

two first electrical transformer output connections provided on the transformer, each of which being connected electrically to the first winding end of the secondary coil; and two second electrical transformer output connections provided on the transformer, each of which being connected electrically to the second winding end of the secondary coil.

9. The loudspeaker arrangement according to claim 2, further comprising:

a first transformer input connection provided on the transformer and connected electrically to a first winding end of the primary coil; and a second transformer input connection provided on the transformer and connected electrically to a second winding end of the primary coil.

10. The loudspeaker arrangement according to claim 2, wherein the transformer includes a transformer housing that is separate from the loudspeaker housing and encloses a transformer housing interior, in which the primary coil and the secondary coil are arranged.

11. The loudspeaker arrangement according to claim 1, wherein the first and second voice coils are connected to each other electrically by low impedance.

12. The loudspeaker arrangement according to claim 1, wherein the first and second voice coils are connected to the secondary coil by low impedance and are isolated galvanically from the primary coil of the transformer.

13. The loudspeaker arrangement according to claim 1, wherein the first and second voice coils are embodied as carry over parts, which have the same inductance.

14. The loudspeaker arrangement according to claim 1, further comprising:

two first electrical loudspeaker input connections on the loudspeaker, each of which is connected electrically with each of the two first winding ends of the first and second voice coils; and two second electrical loudspeaker input connections on the loudspeaker, each of which is connected electrically with each of the two second winding ends of the first and second voice coils.

15. The loudspeaker arrangement according to claim 1, wherein the loudspeaker includes a loudspeaker housing, to which the loudspeaker membrane is attached in such manner as to be able to vibrate freely, and which encloses a loudspeaker housing interior, in which the first and second voice coils are arranged.

16. The loudspeaker arrangement according to claim 1, further comprising:

two first electrical transformer output connections provided on the transformer, each of which being connected electrically to the first winding end of the secondary coil; and two second electrical transformer output connections provided on the transformer, each of which being connected electrically to the second winding end of the secondary coil.

17. The loudspeaker arrangement according to claim 1, further comprising:

a first transformer input connection provided on the transformer and connected electrically to a first winding end of the primary coil; and a second transformer input connection provided on the transformer and connected electrically to a second winding end of the primary coil.

18. The loudspeaker arrangement according to claim 1, wherein the transformer includes a transformer housing that is separate from the loudspeaker housing and encloses a transformer housing interior, in which the primary coil and the secondary coil are arranged.

19. The loudspeaker arrangement according to claim 1, further comprising an electric fuse connected electrically in series with the primary coil, wherein a flow of electrical current through the electric fuse and the primary coil is interrupted when a predetermined threshold value is exceeded.

20. A loudspeaker arrangement comprising:

a loudspeaker having a loudspeaker membrane, a first voice coil, and a second voice coil to provide motive force for the loudspeaker membrane;

an electric transformer having a primary coil connectable electrically to an electrical power unit, and a secondary coil connectable electrically to the first and second voice coils, the primary coil and the secondary coil each having a first winding end and a second winding end;

two first electrical transformer output connections provided on the transformer, each of which being connected electrically to the first winding end of the secondary coil;

two second electrical transformer output connections provided on the transformer, each of which being connected electrically to the second winding end of the secondary coil;

a first transformer input connection provided on the transformer and connected electrically to the first winding end of the primary coil; and a second transformer input connection provided on the transformer and connected electrically to the second winding end of the primary coil;

wherein the first and second voice coils each has two first winding ends and two second winding ends, the two first winding ends being connected to each other via a first electrical conducting path to form a parallel electrical circuit, and the two second winding ends being connected to each other via a second electrical conducting path;

wherein the first electrical conducting path is connected electrically to the first winding end of the secondary coil via a first electrical connecting path and via an additional first electrical connecting path, which forms a parallel circuit with the first electrical connecting path; and wherein the second electrical conducting path is connected electrically to the second winding end of the secondary coil via a second electrical connecting path and via an additional second electrical connecting path, which forms a parallel circuit with the second electrical connecting path.

* * * * *